US005921482A

United States Patent [19]

Chou

[11] Patent Number: 5,921,482

[45] Date of Patent: Jul. 13, 1999

[54] STRUCTURE FOR PAPER SHREDDER IN A WASTE PAPER DISPOSER

[75] Inventor: Reemo Chou, Hsin Tien, Taiwan

[73] Assignee: Sysgration Ltd., Taichung, Taiwan

[21] Appl. No.: 09/191,538

[22] Filed: Nov. 13, 1998

Related U.S. Application Data

[51] Int. Cl.[6] ..... B02C 18/06; B02C 18/16

[52] U.S. Cl. ..... 241/167; 241/236

[58] Field of Search ..... 241/166, 167, 241/236, 100

[56] References Cited

U.S. PATENT DOCUMENTS

| | | | |
|---|---|---|---|
| 5,094,392 | 3/1992 | Szombathy | 241/167 |
| 5,178,336 | 1/1993 | Lodovico et al. | 241/99 |
| 5,484,112 | 1/1996 | Koenig | 241/236 |
| 5,636,801 | 6/1997 | Kroger | 241/167 |

*Primary Examiner*—John M. Husar
*Attorney, Agent, or Firm*—Dougherty & Troxell

[57] ABSTRACT

Disclosed is an improved structure for a paper shredder in a waste paper disposer formed of one piece design composed of a hanging portion, and a shredder body with a plurality of scrapping elements and guiding slots. The structure is divided in two parts, provided respectively at the front and rear sides of a cutter assembly. During operation of the paper shredder, the paper shreds are removed from the cutter assembly by the scrapping elements of the shredder body thereby preventing the paper scraps from sticking on the cutter surfaces. Paper scraps sticking on the cutter blades are removed by barrier tips on the upper ends of the guide slots. When the paper shredder is reversely revolved, the remaining paper shreds on the cutter are removed by the barrier tails formed at the bottom portion of the shredder and the guide slots.

2 Claims, 6 Drawing Sheets

STRUCTURE FOR PAPER SHREDDER IN A WASTE PAPER DISPOSER

BACKGROUND OF THE INVENTION (1) Field of the Invention

This invention relates to an improves structure for a paper shredder in a waste paper disposer, and more particularly, to structure for a paper shredder having a plurality of scrapping elements and guide slots to facilitate cleaning the paper scraps sticking on the cutter assembly.

(2) Description of the Prior Art

A paper shredder in a conventional waste paper disposer is formed as a one-piece design composed of a supporting roll and a shredder body containing a plurality of end plates. The paper shredder is hung up by inserting its supporting roll into the roll hole. The plurality of shredder end plates adjoin deeply with each other and with cutter blades for cleaning paper scraps cut by the cutter blades. It is a shortcoming of the conventional paper shredder that only the end plates are responsible for removing the paper scraps while the supporting roll remains idle without aiding the clean up of the paper scraps. Such an imperfect design results in very little cleaning effect of paper scraps. Besides, an H shaped assembly of cascaded paper shredder end plates hanging on a slim supporting roll makes the whole structure weak, unsecured, and unstable.

To solve the above mentioned problems, the inventor of the present invention has succeeded in developing an improved structure for a paper shredder which is not only able to thoroughly clean up the paper scraps sticking on the cutter assembly, but also has an enhanced structure. Now this fruitful result from his long-term study and efforts will be disclosed herein.

SUMMARY OF THE INVENTION

It is an object of the present invention to provide an improved structure for a paper shredder which is not only able to thoroughly clean up the paper scraps sticking on the cutter assembly, but also has enhanced mechanical strength.

To achieve the above mentioned object, the present invention provides an improved structure for a paper shredder formed of a one piece design composed of a hanging portion, a shredder body with a plurality of scrapping elements and guide slots. The structure of the present invention is divided in two parts, provided respectively at the front and rear sides of the cutter assembly being hung up by a connecting rod by inserting the connecting rod into the shaft hole. During the operation of the paper shredder, the paper scraps cut by the cutter are removed from the cutter by scrapping elements of the shredder body thereby preventing the paper scraps from sticking on the cutter surfaces, while the paper scraps sticking on the cutter blades are removed by barrier tips on the upper ends of the guide slots. When the paper shredder is reversely revolved, the remaining paper shreds on the cutter are removed by the barrier tails formed at the bottom portion of the shredder and the guide slots. The structure for a paper shredder designed as such is not only able to thoroughly clean up the paper sticking on the cutter assembly, even in the case of revolving reversely for fault clearing, but also has an enhanced mechanical strength.

BRIEF DESCRIPTION OF THE DRAWINGS

The above object and advantages of the present invention will become more apparent by describing in detail a preferred embodiment thereof with respect to the attached drawings in which.

DESCRIPTION OF THE PREFERRED EMBODIMENTS

Figure 1:
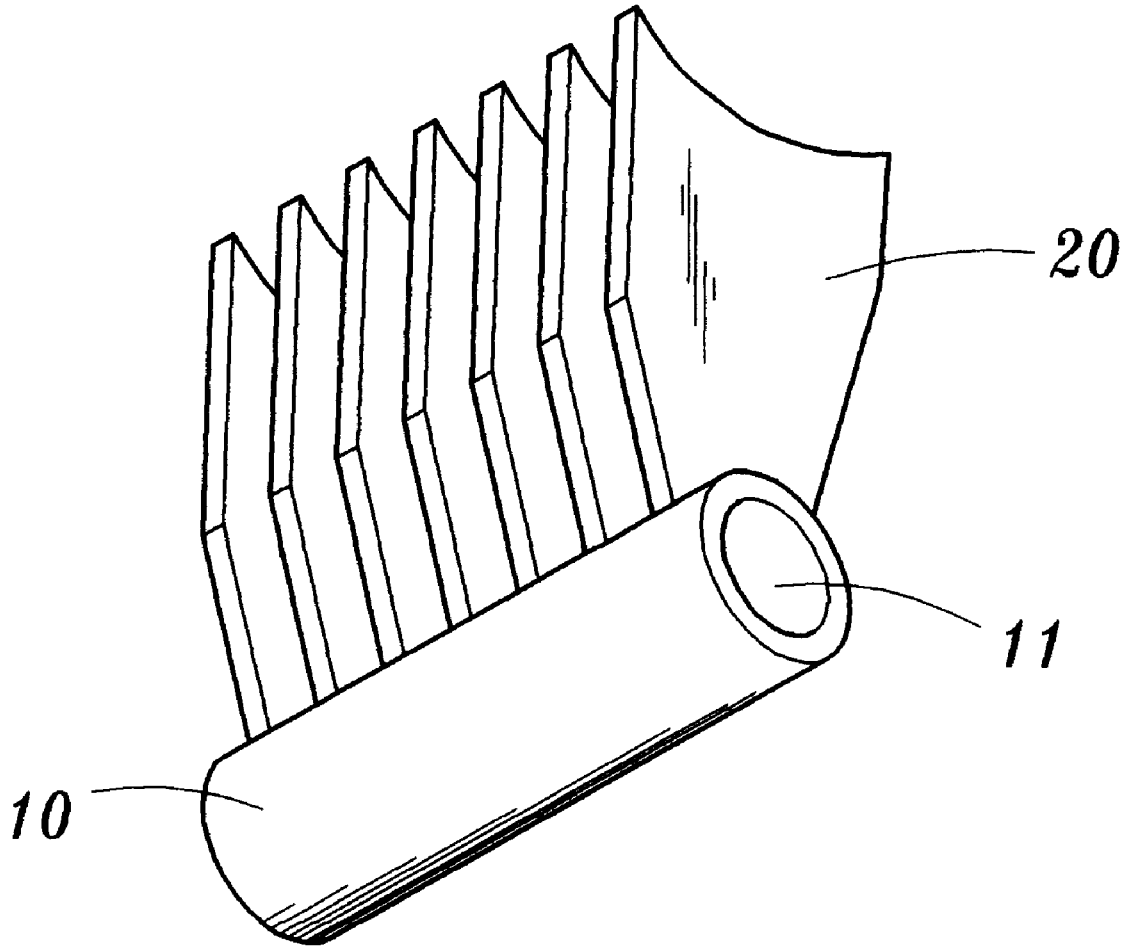
FIG. 1 PRIOR ART
FIG. 1 is a perspective view of a conventional paper shredder.
Figure 2:
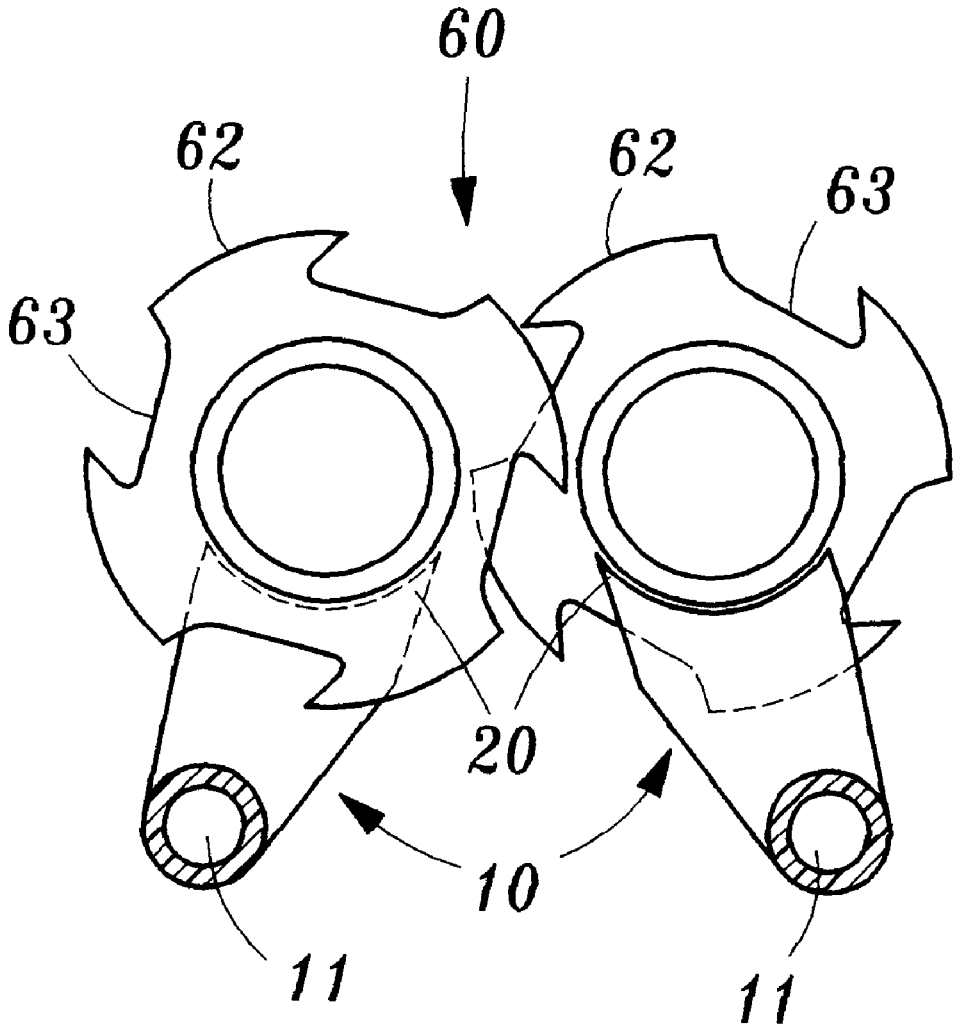
FIG. 2 PRIOR ART
FIG. 2 is a side view of a cutter assembly for a conventional paper shredder.
Figure 3:
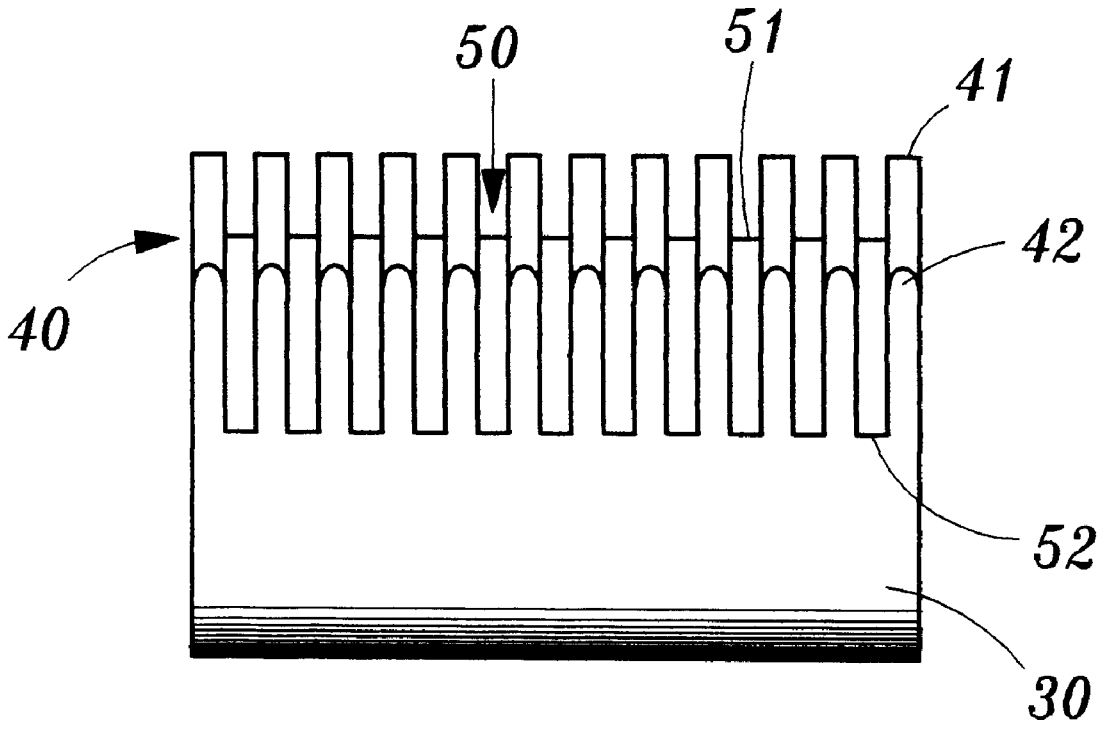
FIG. 3 is a front view of the paper shredder according to the present invention.
Figure 4:
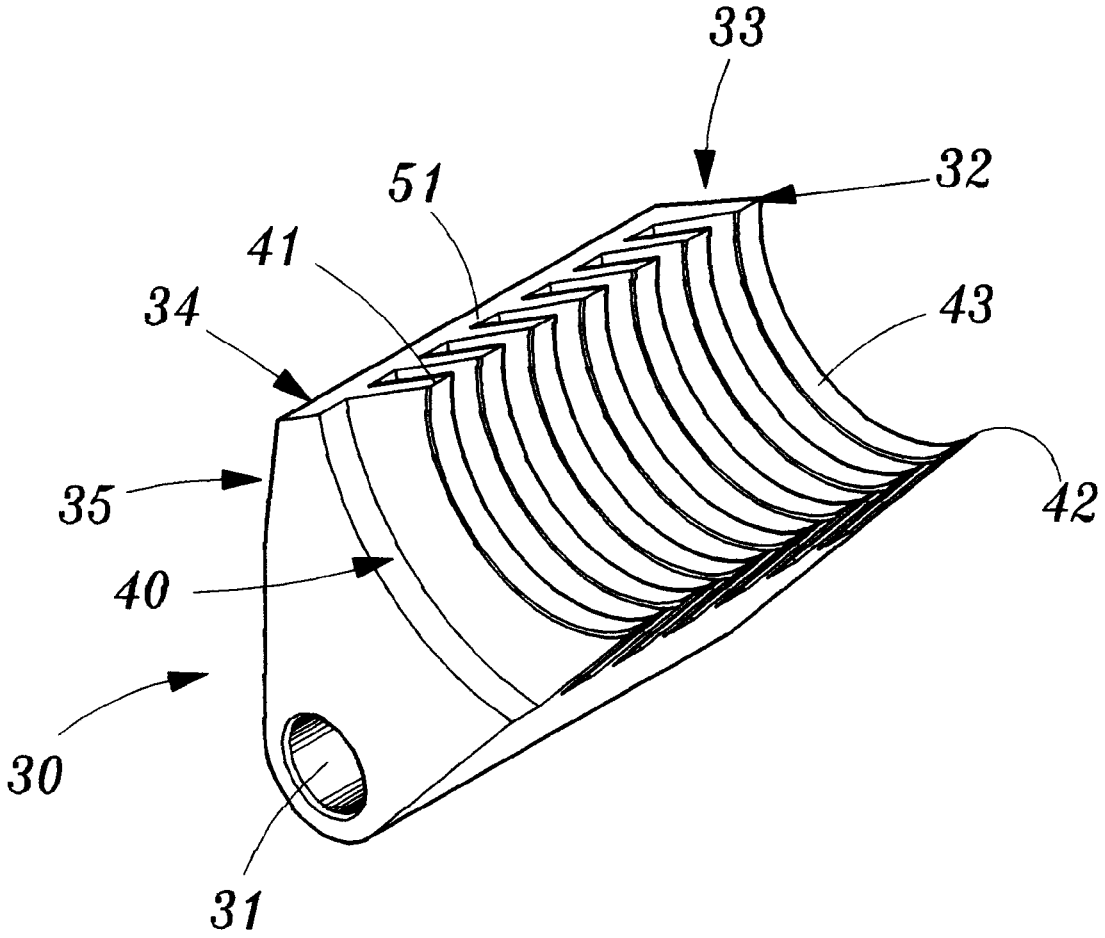
FIG. 4 is a perspective view of the paper shredder according to the present invention.
Figure 5:
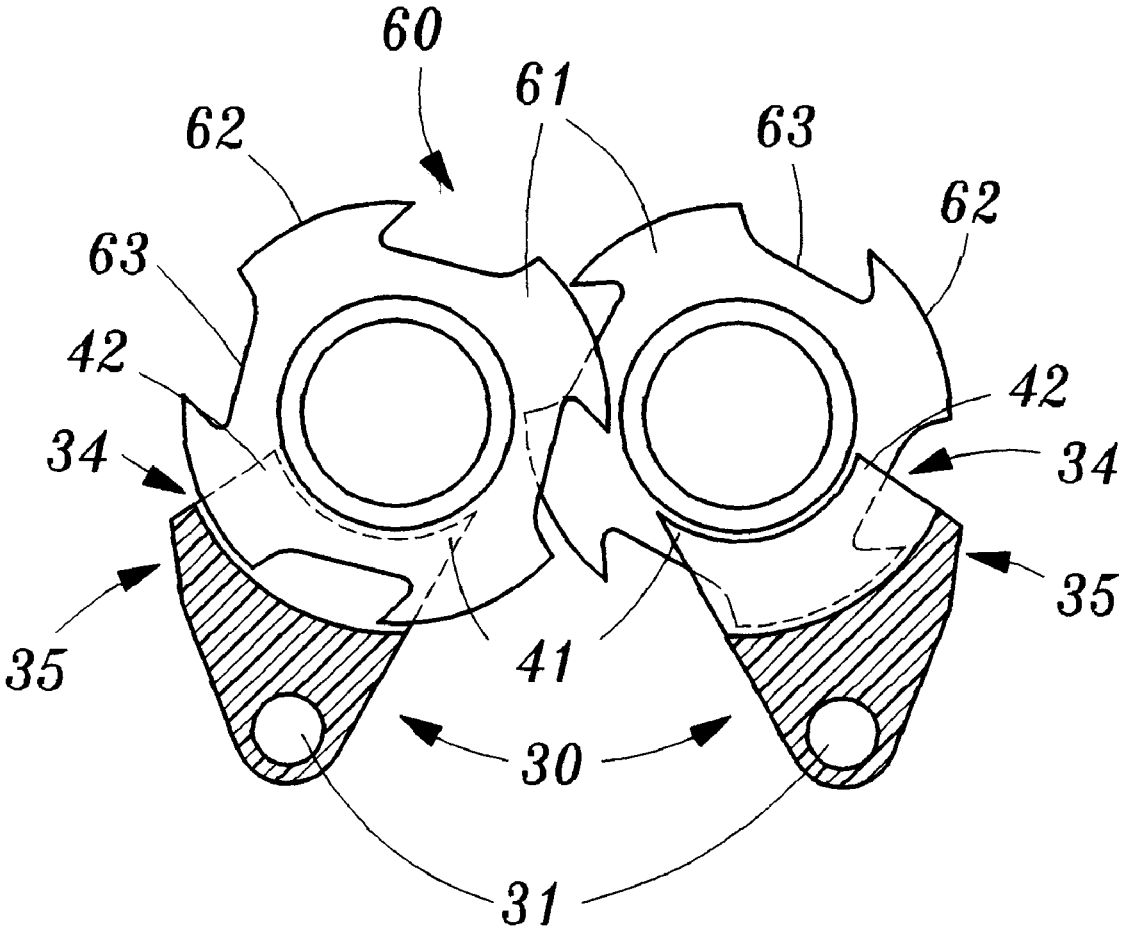
FIG. 5 is a side view showing the cutter assembly for the paper shredder according to the present invention.
Figure 6:
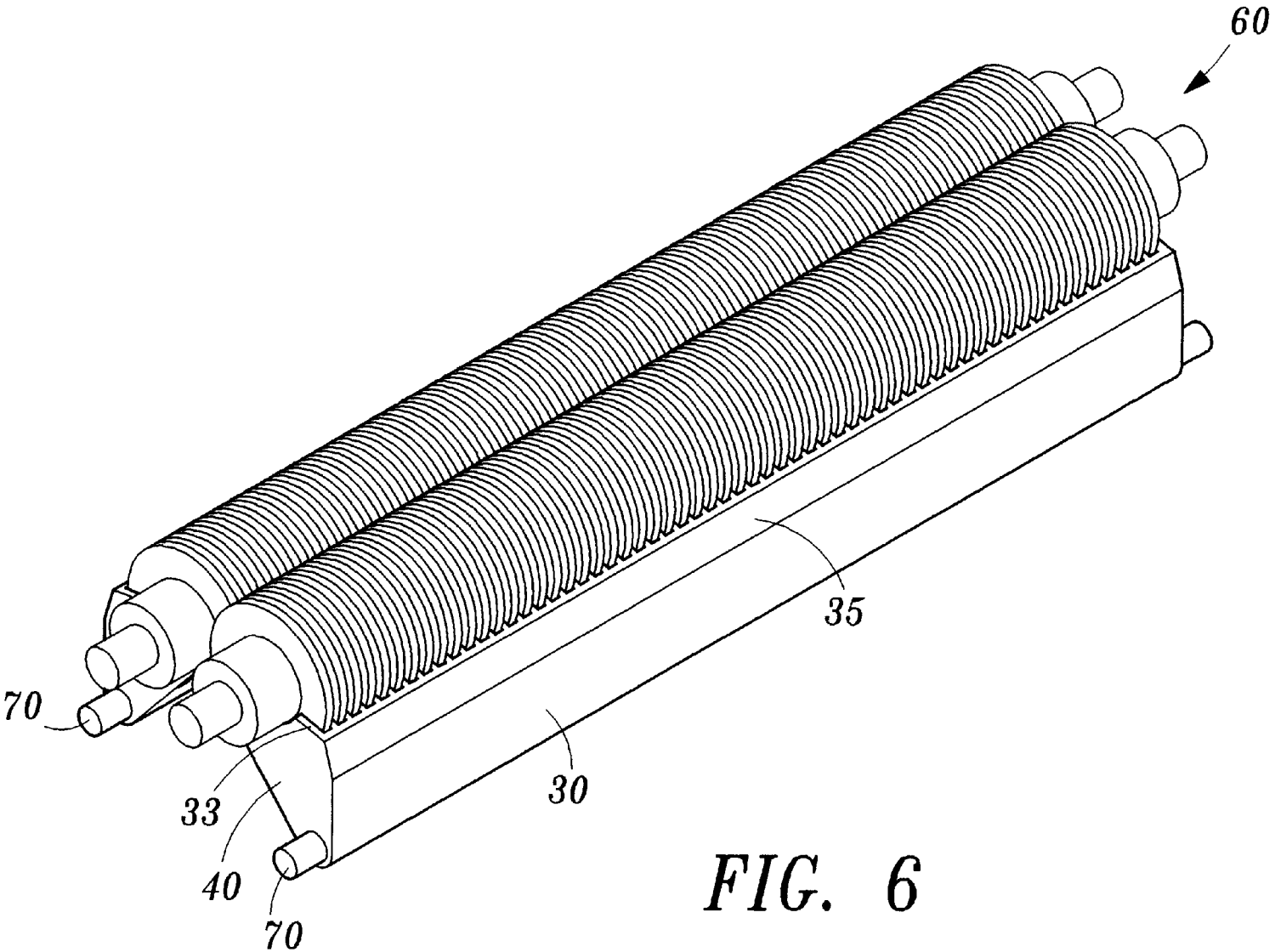
FIG. 6 is a perspective view of the paper shredder in an embodiment according to the present invention.

A structure for a conventional paper shredder shown in FIG. 1 and FIG. 2, is formed as a one piece design composed of a supporting roll 10 and a shredder body 20 containing a plurality of end plates. The paper shredder is hung up with a connecting rod (not shown) by inserting its supporting roll 10 into the roll hole 11. The paper shreds produced by a cutter assembly 60 are removed by the ends of shredder body 20. However, it is an imperfect design in that only the end plates of the shredder body 20 are responsible for removing the paper scraps while the supporting roll 10 remains idle without aiding the clean up of the paper scraps. Such an imperfect design results in very little cleaning effect of paper scraps regardless of which direction the cutter assembling 60 is revolving. Besides, an H shaped assembly of cascaded paper shredder end plates 20 hanging on a slim supporting roll 10 makes the whole structure weak, unsecured, and unstable.

An improved structure for a paper shredder according to the present invention is shown in FIGS. 3 through 6. It is formed of a one piece design composed of a hanging portion 30, a shredder body 40 with a plurality of scrapping elements and a plurality of guide slots 50. In the structure of the present invention, the number of paper scriber sets may be adjusted to meet the actual requirement according to the type of waste paper disposer and width of cutters. Moreover, the paper shredder may be divided in two parts, each provided at the front and rear sides of cutter assembly 60 and hung by a connecting rod 70. At the bottom side of the hanger portion 30, there is provided a shaft hole 31 for supporting by an inserted connecting rod 70. The upper part of the hanging portion 30 is formed of a one piece design composed of a shredder body 40 with a plurality of end plates and a plurality of guide slots 50. The arc angle of the arc shaped edge 43 on the right upper part of the shredder body 40 is slightly larger than that of valley 63 of the cutter 61 so as to match with each other in the cutting operation. On the other hand, the inner side of the guide slot 50 is also designed to have an arc angle closely matched with that of the blade 62 of the cutter 61 for efficiently performing the cutting operation. The scrapping elements of the shredder body 40 and the guide slots 50 intervene with each other. At the left upper part of hanging portion 30, is a barrier tip 51 on the upper end of the guide slot 50, formed into a first sloped surface 33 with a cut angle 32, and furthermore, a second sloped surface 35 with a second cut angle 34 is formed at the lower edge of the first sloped surface so as to enable the cutter 61 to clean up the paper scraps smoothly along a desired direction when the paper shredder is reversely revolved.

In assembly the sophisticated structure of the present invention, care must be taken to adjoin a plurality of strap shaped scrapping elements of the shredder body 40 with the blades 62 of the cutter 61 and keep closely matched with the adjacent cutter valleys 63. The guide slots 50 are closely matched with adjacent blades 62 of the cutter 61. When the paper shredder is in operation, the paper shreds produced by cutting action of cutter assembly 60 are removed by the end portion of the shredder body 40 thereby preventing the paper scraps from sticking on the cutter valleys 63. The paper shreds remaining on the blades 62 of cutter 61 are cleaned by the barrier tips 51 on the upper ends of the guide slots 50. Furthermore, when the apparatus is reversely revolved, the residual paper shreds remaining on the cutter assembly may be cleaned by the bottom portion 42 of the shredder body 40 and barrier tails 52 at the lower end of guide slots 50.

An improved structure for a paper shredder in a waste paper disposer according to the present invention is not only able to thoroughly clean up the paper scraps sticking on the cutter assembling, but also has enhanced mechanical strength.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims:

I claim:

1. A paper shredder having at least two cutter assemblies rotatable in a cutting direction, each cutter assembly having a plurality of cutters extending from a support member having a circular outer surface, the cutter assemblies located such that the cutters of the at least two cutter assemblies are interleaved with each other, each cutter having an arcuate periphery, the shredder comprising at least two shredder bodies, each shredder body having a hanging portion, a plurality of spaced apart scrapping elements extending from the hanging portion, and forming a plurality of guide slots therebetween, each scrapping element having a first arcuate surface, a base of each guide slot having a second arcuate surface, one shredder body associated with each cutter assembly such that the scrapping elements and cutters are interleaved, the first arcuate surfaces being located adjacent to the outer surface of the support member, and the second arcuate surfaces being located adjacent to the arcuate peripheries of the cutter blades, each shredder body having a barrier surface facing in the direction of rotation of the associated cutter assembly, the barrier surface including end surfaces of the plurality of the scrapping elements, at least a portion of which extends between spaced apart cutters, whereby the barrier surface removes paper scraps from the cutters when the cutter assemblies are rotated opposite to the cutting direction.

2. The paper shredder of claim 1, wherein the barrier surface comprises a first barrier portion which faces in the direction of rotation and a second barrier surface portion extending from the first barrier surface portion and facing in a different direction then the first barrier portion.

* * * * *